United States Patent [19]

Pretorius

[11] Patent Number: 4,630,537

[45] Date of Patent: Dec. 23, 1986

[54] SELECTIVE EMBOSSER WITH BUCKLING PREVENTION

[75] Inventor: David J. Pretorius, Pretoria, South Africa

[73] Assignee: The National Savings & Finance Corp. (Proprietary) Limited, Johannesburg, South Africa

[21] Appl. No.: 768,174

[22] Filed: Aug. 22, 1985

Related U.S. Application Data

[63] Continuation of Ser. No. 502,541, Jun. 14, 1983, abandoned, which is a continuation of Ser. No. 279,064, Jun. 30, 1981, abandoned.

[30] Foreign Application Priority Data

Jul. 2, 1980 [ZA] South Africa ..... 80/3982

[51] Int. Cl.[4] ..... B31F 1/07; B44B 5/00

[52] U.S. Cl. ..... 101/3 R; 101/28; 101/32; 72/428; 72/453.01; 72/701

[58] Field of Search ..... 101/26-32, 101/4, 3 R, 18; 72/414, 701, 420, 426, 428, 453.01, 453.14

[56] References Cited

U.S. PATENT DOCUMENTS

| | | | |
|---|---|---|---|
| 1,571,614 | 2/1926 | Willwerscheid | 101/18 |
| 2,940,497 | 6/1960 | Herrstrum | 72/453.01 |
| 3,002,547 | 10/1961 | Cootes | 72/453.01 |

*Primary Examiner*—Edgar S. Burr
*Assistant Examiner*—David A. Wiecking
*Attorney, Agent, or Firm*—Murray and Whisenhunt

[57] ABSTRACT

A method and apparatus for embossing characters on a plate such as a motor vehicle registration plate are provided according to which the blank plate and dies are located between the movable and stationary members of a press, the movable member being contained in a cylinder wherein pressurized fluid can cause it in the nature of a piston to move towards the stationary member in order to effect the embossing operation on the plate.

11 Claims, 7 Drawing Figures

Fig 3.
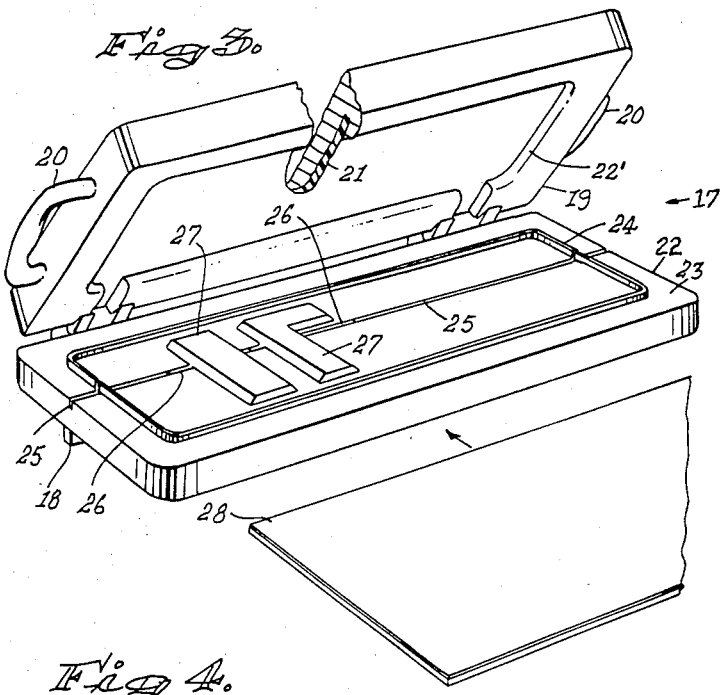
Fig 4.
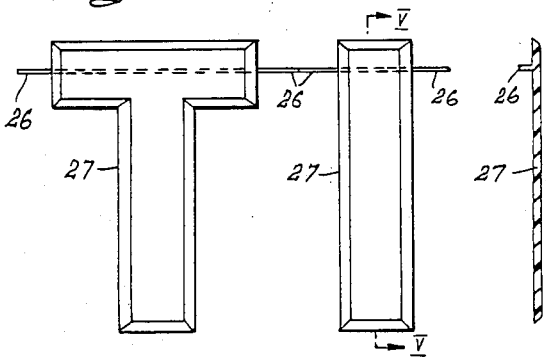
Fig 5.

SELECTIVE EMBOSSER WITH BUCKLING PREVENTION

This application is a continuation of Ser. No. 502,541, filed June 14, 1983, now abandoned, which is a continuation of Ser. No. 279,064, filed June 30, 1981, now abandoned.

THIS invention relates to a method and means of embossing. More particularly it relates to a method and means of embossing characters on plates such as for example motor vehicle registration plates or the like.

The conventional embossing means usually includes two co-operating members which are movable relative to each other and between which the work piece to be embossed is located. The one member comprises a die member of which the operative face is adapted to overlie the work piece and movement of the members relative to each other is caused by one or more movable arms responsible for forcing the two members towards each other in order to effect the embossing operation. The arms are usually pneumatically or hydraulically operated.

In an embossing operation, especially where the work piece is of metal or a similar rigid material, it is necessary for the operative face of the die member and the co-operating member to be absolute parallel to each other and for the force exerted by the members on the work piece during the embossing operation to be equally spaced over the whole of the work piece. If this is not so, the embossed characters to not have the same relief thickness while often it will result in the work piece being distorted, for example buckled, during the embossing operation. In the aforesaid known arrangements it is found that the pressing force of the members tends to be more pronounced in those areas where the arms act on the members and that this often results in an imperfect embossing operation giving a product with shortcomings of the type referred to.

It is accordingly an object of this invention to provide a method and means with which the aforesaid problems may be overcome or at least minimized.

According to the invention an embossing apparatus includes a pair of co-operating members which are movable relative to each other in order to emboss characters on a work piece located between them, at least one of the members being movable in a cylinder in the nature of a piston as a result of a pressurized fluid in the cylinder acting directly on the member.

With this arrangement the force exerted on the member by the pressurized fluid will be spread equally over the whole of the operative face of the member. At the same time movement of the member will be guided by the cylinder walls, in this way ensuring that the operative face of the member will always be maintained in parallel relationship to the operative face of the co-operating member.

Preferably the pressurised fluid comprises a suitable hydraulic fluid.

Further according to the invention the other co-operating member is non movable and comprises a transversely extending wall associated with the cylinder.

Still further according to the invention the operative face of the other co-operating member is associated with a pad of a resiliently flexible material.

It will be appreciated that during the embossing operation the pad will yield in those areas where the characters are formed in the work piece in this way allowing for the deformation of the material of the work piece in such areas.

Further according to the invention the movable member carries one or more dies intended to effect the embossing in the work piece.

Still further according to the invention the dies are carried on a tray which in turn is adapted to be carried on the movable member.

Preferably each die includes one or more locating formations adapted releasably to engage co-operating formations on the tray in order to secure the dies to the tray in predetermined relationship to one another.

The locating formation on a die may for example comprise a protrusion adapted slidably to engage a complementary shaped recess in the tray.

In one preferred form of the invention the recess may comprise a slot extending parallel to the longitudinal edges of the tray and the die may include a pin adapted slidably to engage the slot.

With this arrangement individual dies may be moved into the required interrelationship with other dies in order to emboss characters in any particular legend in the work piece.

Preferably the pins also extend in the plane of the die on opposite sides thereof so that when the pins of adjacently located dies engage, the dies are spaced a predetermined distance from each other.

In another preferred form of the invention, the locating formations may comprise two parallel spaced ribs adapted slidably to receive the dies between them.

Further according to the invention the tray has a cover adapted to overlie a work piece on the tray, the face of the cover intended to engage the work piece including the pad of a resiliently flexible material referred to above as being associated with the non movable member.

When such a tray, with its cover, and dies and a work piece sandwiched between them, is trapped between the movable and non movable members of the apparatus, the resiliently flexible pad will yield in those areas overlying the dies in order to allow the latter to emboss the characters in the material of the work piece.

Further according to the invention the operative face of the movable member has a platform integral with it adapted for receiving the tray.

Preferably at least one end of the platform extends into an aperture provided in the side wall of the cylinder, through which aperture the tray and work piece may be slidably received.

Preferably also the platform includes a guide formation adapted to be engaged slidably by a co-operating formation on the tray.

Preferably also the guide formation comprises a longitudinally extending slot and the co-operating formation on the tray a complementary shaped rib.

Further according to the invention the apparatus includes a work surface which is flush with the aperture in the cylinder, and which also includes a guide formation corresponding to the one on the platform with which it can co-operate so that the tray may be guided in turn by the two formations when the tray is passed into the cylinder through the aperture in its side wall.

In one embodiment of the invention the dies may include a cutting edge adapted during the embossing operation to cut through a layer of material carried on the work piece.

These dies may for example be utilised for cutting through a sheet of reflective material adhesively secured to the work piece, the cutting being effected all along the peripheries of the embossed characters so that the cut out material can be removed to expose the operative face of the work piece.

Further according to this aspect of the invention each die is defined by two co-operating elements which are adapted to overlie each other in a manner so that the work piece can be sandwiched between them, the operative face of the one element including an raised formation intended as the punch of the die and the operative face of the other element including a recess of complementary shape and size to the raised formation, the recess being intended as the anvil of the die and the wall of the recess defining the said cutting edge.

Still further according to the invention the recess is of a substantially hard rigid material while the rest of the operative face of the element surrounding the recess is of a resiliently flexible material.

With this arrangement when the two elements, with a work piece provided with a layer of reflective material sandwiched between them, are trapped between the movable and non movable members of the apparatus the raised formation will punch the relevant part of the work piece into the recess to emboss the relevant character in the material and when that part of the operative face of the punch element surrounding the raised formation engages the resilient flexible material on the anvil element the material will yield to allow the cutting edge defined by the walls of the recess to cut through the layer of reflective material.

Preferably the two elements are hingedly connected to each other in a manner to ensure that when they are closed onto each other the raised formation and recess move into engagement with each other.

Preferably the hinged connection between the two elements is such that when they are in the closed position they can move relative to each other in a direction transversely the planes of their operative faces while maintaining their operative faces in parallel relationship to each other.

Further according to this aspect of the invention the tray on which the dies are located for insertion into the cylinder through the aperture in its side wall includes two parallel spaced longitudinally extending rib formations adapted to receive a die slidably between them.

The invention will now be described further by way of example with reference to the enclosed drawings wherein:

FIG. 3 is a diagrammatic perspective view showing part of the apparatus of FIG. 1 in more detail.

FIG. 4 is a diagrammatic plan view of two dies usable with the apparatus of FIG. 1;

FIG. 5 is a cross section along thelines V—V of FIG. 4;

Figure 1:
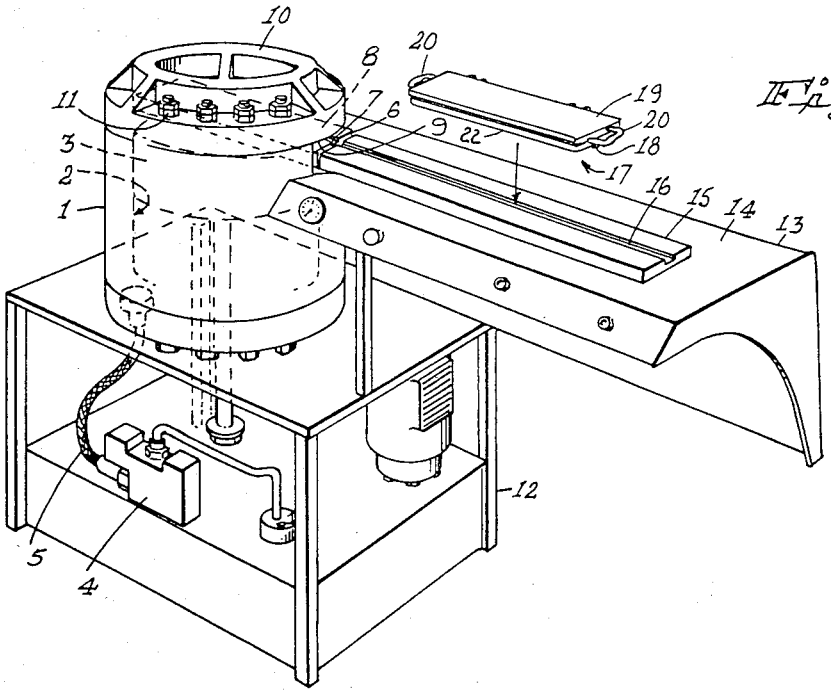
FIG. 1 is a diagrammatic perspective view (partly exploded) of apparatus according to the invention intended for carrying out one embodiment of the invention.

Referring now to the embodiment of the invention shown in FIGS. 1 and 3–6, the apparatus of the invention includes a hollow cylinder 1 which has a bore 2 of circular configuration housing a piston 3 of complementary configuration which can be made to reciprocate in bore 2 as a result of pressurised hydraulic fluid being passed by a pump 4 via a conduit 5 into the lower part of bore 2.

The upper end of piston 3 defines a platform 6 which is of elongated rectangular configuration and which includes slot 7 along the operative face 8 thereof.

The side wall of cylinder 1 includes towards its upper end two diametrically opposed apertures 9 through which the ends of platform 6 protrude.

A top 10 defining a wall extending transversely across the upper end of bore 2 is secured by means of nuts and bolts 11 to the upper end of cylinder 1.

Cylinder 1 and pump 4, with its associated compressor, are carried on a frame 12.

A table 13, defining a work surface 14, is also carried on frame 12.

Work surface 14 includes an elongated raised formation 15 which is of complementary configuration to platform 6 with which it is in alignment so that a longitudinally extending slot 16 on its upper face is also in alignment with slot 7 on platform 6.

An elongated die 17 of which the length is less than that of platform 6 includes along its underside a rib 18 (FIG. 3) adapted slidably to engage slot 16. Die 17 includes a top die member 19 provided with two handles 20, and which has a pad 21 of resiliently flexible material such as rubber for example which is housed in a recess 22′ in the underside of member 19. Die 17 also includes a bottom die member 22.

Face 23 of bottom die member 22 includes a peripherally extending ridge 24 adapted to engage the surrounds of the recess 22′ on the underside of top die member 19. Face 23 also includes a longitudinally extending groove 25 adapted to be engaged slidably by locating formations 26 which are provided on die elements 27 to extend transversely the planes of the die elements. Formations 26 are of such length that when the formations of adjacent dies 27 abut, the die elements are spaced a predetermined distance from each other.

A blank plate 28, intended to be embossed, is adapted to be sandwiched between top and bottom die members 19 and 22 so that its underside engages die elements 27 on die 17.

In operation die 17 is loaded with the relevant die elements 27 which are required to emboss a particular legend of characters onto plate 28. By sliding die elements 27 to-and-fro along slot 25, they may be brought into the required particular interrelationship. Plate 28 is then located over die elements 27 and member 19 located over die 17 so that recess 22′ can receive rib 24 in it.

The loaded die 17 is then located on bed 15 so that the rib 18 thereof engages slot 16. Die 17 is then moved along slots 16 and 7 through aperture 9 until it is located on platform 6 inside cylinder 1.

When pump 4 is actuated, pressurised fluid passing into bore 2 of cylinder 1 causes piston 3 to move upwardly to trap die 17 between platform 6 and the underside of top 10. As a result of the pressure exerted by the press, die elements 27 emboss the relevant characters in plate 28, the resiliently flexible pad 21 allowing for the deformation of the material of plate 28 in the embossed areas.

Because the pressure exerted by platform 6 is spread equally over the entire surface of plate 28, a very smooth embossing is achieved without any buckling of plate 28.

When the pressure exerted by the press is released, the embossed plate may be removed by sliding it along slot 7 through either of the apertures 9 out of cylinder 1.

Figure 2:
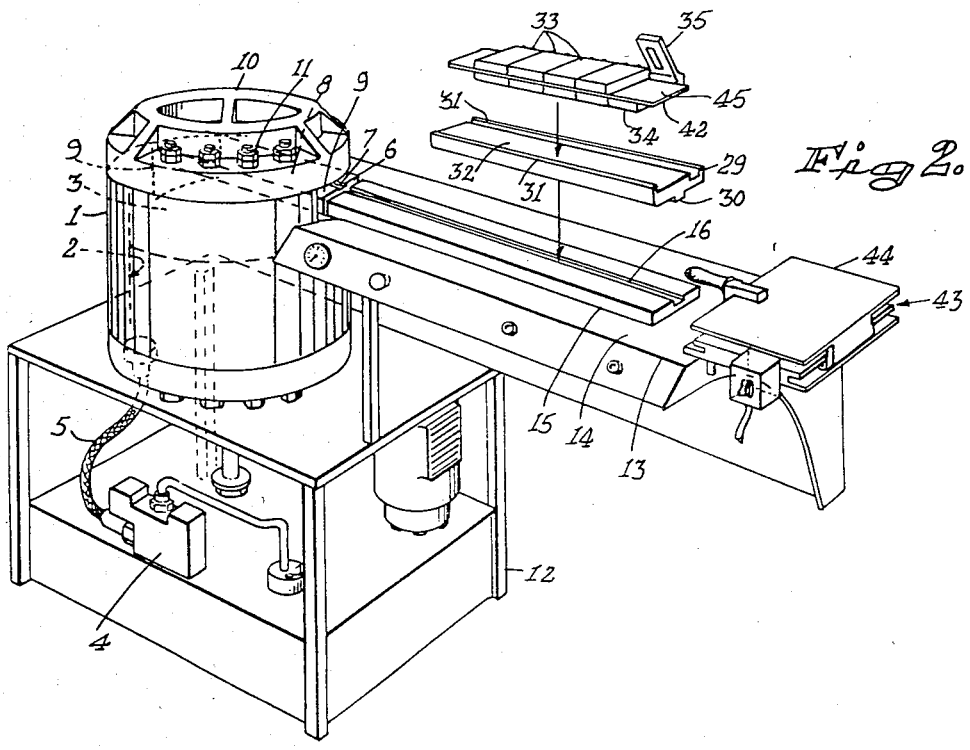
FIG. 2 is a similar view showing a modification to the apparatus of FIG. 1 intended for carrying out another embodiment of the invention.
Figure 6:
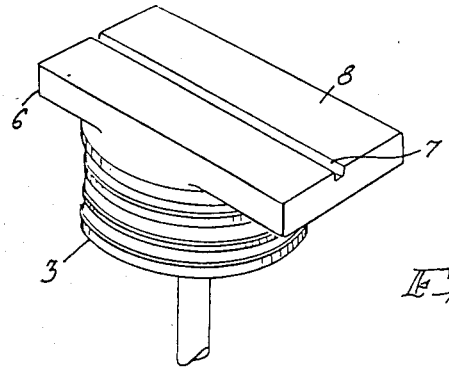
FIG. 6 is a diagrammatic perspective view of a part of the apparatus of FIGS. 1 and 2.
Figure 7:
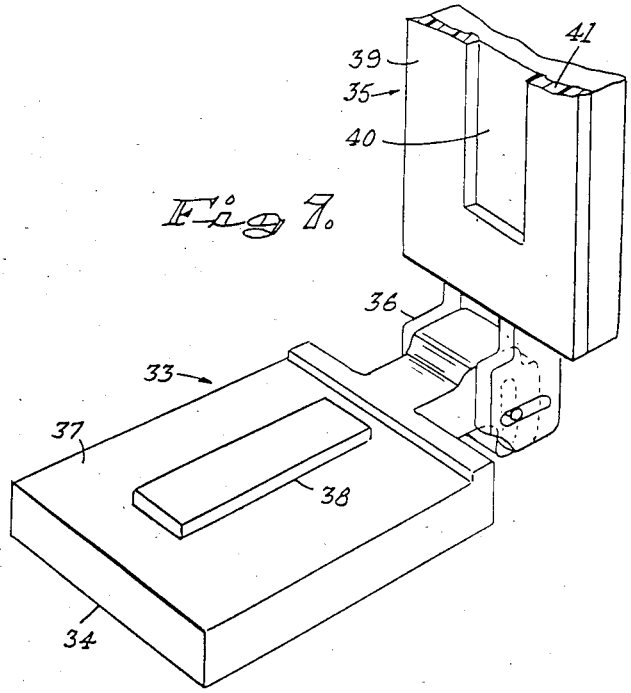
FIG. 7 is a diagrammatic perspective view showing part of the apparatus of FIG. 2 in more detail.

In the embodiment shown in FIGS. 2, 6 and 7, where parts numbered 1–16 correspond with the similarly numbered parts referred to above in respect of the previously described embodiment, a tray 29, of substantially the same length as die 17 of the previously referred to embodiment, includes a longitudinally extending rib formation 30 which can slidably engage slot 16.

Tray 29 also includes along each of its two longitudinal edges a rib formation 31 so that a channel 32 is defined between them. Channel 32 is adapted slidably to receive between ribs 31 one or more dies 33.

As is indicated in more detail in FIG. 7, each die 33 comprises two members 34 and 35 which are pivotally connected at 36 to each other.

Die member 34 includes on its face 37 a raised formation 38 defining the punch of the die. Die member 36 includes on its face 39 a recess 40 which is of complementary configuration to raised formation 38 and which constitutes the anvil of the die.

The walls of recess 40 are machined into a hard metal body which is surrounded by a pad 41 of a resiliently flexible material such as hard rubber for example. The walls of recess 40 define knife edges, the purpose of which will later be explained.

The pivotal connection at 36 between member 34 and 35 is such that when the two members are in the 'closed' position, i.e. where their faces 37 and 39 abut and raised formation 38 is located inside recess 40, the two members are capable of limited to-and-fro movement relative to each other while remaining in parallel relationship to each other. A blank plate 42, intended to be embossed, can accordingly be received between the members 34 and 35 of a plurality of adjacently located dies 33 as is indicated in FIG. 2.

Table 13 also carries an electrically operated oven 43 which has a lid 44 and the purpose of which will be explained later.

In operation the blank plate 42, which may for example be of a suitable material such as steel, aluminium, etc, and which has been prepainted with a preferred colour say black, is provided over its painted face with a sheet 45 of reflective material. Sheet 45 is adhesively secured to plate 42 by means of a two stage temperature sensitive adhesive which has only been heated to the first of the two temperatures.

A plurality of dies 33, which each provides one of the characters to be embossed in plate 42, are located in channel 32 of tray 29 between ribs 31 in the required interrelationship to define a particular legend.

Members 35 of dies 33 are then pivoted open so that plate 42 can be received and trapped between members 34 and 35 on closing of the members.

The loaded tray 29 is then moved along slots 16 and 7 into cylinder 1 in the same way as described above for the other embodiment.

When piston 3 is now activated, the loaded tray 29 is trapped between platform 6 and the underside of top 10 and the pressure so exerted on the members 34 and 35 causes raised formation 38 to emboss a particular character in plate 42, the recess 40 allowing for the required deformation of the plate material.

After a particular character has been embossed in plate 42 the flexibility of pad 41 allows members 34 and 35 to move still further towards each other and this causes the knife edges provided by the walls of recess 40 to cut through reflective layer 45.

It will be appreciated that for the same reasons given above, a very smooth embossing is achieved without causing any buckling to plate 42.

When the embossed plate is now removed from the apparatus, the cut out parts of reflective layer 45 may be stripped from plate 42 to expose the painted surfaces of plate 42, which surfaces will of course be on the embossed characters.

Lid 44 of oven 43 is then lifted and plate 42 is then located in oven 43 and heated to the second of the aforesaid two temperatures of the adhesive. This causes the reflective layer 45 to become permanently fixed to plate 42.

It will be appreciated that in this embodiment of the invention a completely finished embossed plate ready for use is provided in a single production line.

It will further be appreciated that the invention also includes within its scope a method of embossing a work piece substantially as herein described.

It will still further be appreciated that there are many variations in detail possible with a method and means according to the invention without departing from the scope of the apended claims.

I claim:

1. Apparatus for embossing characters in a workpiece such as a motor vehicle registration plate, said apparatus comprising:

(a) buckling prevention means for preventing buckling of said workpiece during embossing, said buckling prevention means comprising:

a pair of cooperating press members reciprocally movable relative to each other and each having an operative face, at least one of said press members being movable and having an elongated configuration defining a piston which is snugly slidably received in a cylinder, said piston having an upper surface defining one of said operative faces, said piston and its operative face remaining substantially within said cylinder during movement of said piston in said cylinder, thereby preventing the operative face of the movable press member from moving out of alignment with the operative face of the other press member during movement of the movable press member relative to the other press member during the embossing operation;

at least on die for embossing one or more characters in said workpiece, said at least one die comprising first and second pivotally interconnected die members, said workpiece, during the embossing operation, being trapped between said first and second pivotally interconnected die members to provide a die/workpiece assembly, said die/workpiece assembly being locatable for the embossing operation between said pair of cooperating press members, said operative faces of said press members being of such dimensions that they extend over the whole of the die/workpiece assembly during the embossing operation;

(b) at least one die element carried by said first die member;

said press members during the embossing operation exerting pressure equally over the entire/workpiece assembly to prevent buckling of said workpiece and to ensure evenly shaped embossed characters.

2. The apparatus of claim 1, wherein said operative face of said movable press member has an elongated platform integral with it, one end of said platform extending into an aperture provided in a sidewall of said cylinder and through which said at least one die and said workpiece may be slidably located onto said platform.

3. The apparatus of claim 2, wherein said platform contains a longitudinally extending slot and said at least one die has a complementary shaped rib formation adapted slideably to engage said slot.

4. The apparatus of claim 2, including a work surface which is flush with said aperture in said side wall of said cylinder, said work surface having an elongated slot which is in linear relationship to a similar slot in said platform, said at least one die including an elongated rib formation of complementary configuration to each said slot so that said at least one die can be guided by said slots when said die/work piece assembly is moved from said work surface into said cylinder through said aperture.

5. The apparatus of claim 1, and further including a cutting means for cutting through a layer of material carried on said work piece during the embossing operation, said cutting means including a raised formation on said first die member and a recess in said second die member having a complementary shape and size to said raised formation, said recess having a surrounding wall defining a cutting edge for cutting through said layer of material carried on said work piece as said raised formation is urged into said recess.

6. The apparatus of claim 1, wherein said second die member includes a recess of complementary shape and size to said die element, said recess being surrounded by a pad of resiliently flexible material which during the embossing operation abuts a part of said first die member surrounding said die element.

7. Apparatus for embossing characters in a workpiece such as a motor vehicle registration plate, said apparatus comprising:

(a) buckling prevention means for preventing buckling of said workpiece during embossing, said buckling preventions means comprising:

a pair of cooperating press members reciprocally movable relative to each other and each having an operative face, at least one of said press members being movable and having an elongated configuration defining a piston which is snugly slidably received in a cylinder, said piston having an upper surface defining one of said operative faces, said piston and its operative face remaining substantially within said cylinder during movement of said piston in said cylinder, thereby preventing the operative face of the movable press member from moving out of alignment with the operative face of the other press member during movement of the movable press members relative to the other press member during the embossing operation;

a die for embossing one or more characters in said workpiece, said die comprising first and second pivotally interconnecting die members, said workpiece, during the embossing operation, being trapped between said first and second pivotally interconnecting die members to provide a die/workpiece assembly, said die/workpiece assembly being locatable for the embossing operation between said pair of cooperating press members, said operative faces of said press members being of such dimensions that they extend over the whole of the die/workpiece assembly during the embossing operation;

(b) at least one die element carried by said first die member;

said press members, during the embossing operation exerting pressure equally over the entire die/workpiece assembly to prevent buckling of said workpiece and to ensure evenly shaped embossed characters.

8. Apparatus for embossing characters in a workpiece such as a motor vehicle registration plate, said apparatus comprising:

(a) buckling prevention means for preventing buckling of said workpiece during embossing, said buckling prevention means comprising:

a pair of cooperating press members reciprocally movable relative to each other and each having an operative face, at least one of said press members being movable and having an elongated configuration defining a piston which is snugly slidably received in a cylinder, said piston having an upper surface defining one of said operative faces, said piston and its operative face remaining substantially within said cylinder during movement of said piston in said cylinder, thereby preventing the operative face of the movable press member from moving out of alignment with the operative face of the other press member during movement of the movable press member relative to the other press member during the embossing operation;

a plurality of dies for embossing one or more characters in said workpiece, each of said dies comprising first and second pivotally interconnected die members said workpiece, during the embossing operation, being trapped between said first and second pivotally interconnected die members of each of said dies to provide a dies/workpiece assembly, said dies/workpiece assembly being locatable for the embossing operation between said pair of cooperating press members, said operative faces of said press members being of such dimensions that they extend over the whole of the dies/workpiece assembly during the embossing operation;

a tray for carrying said dies/workpiece assembly, and being locatable for the embossing operation between said pair of cooperating press members;

(b) a die element carried by said first die member of each of said dies;

said press members, during the embossing operation, exerting pressure equally over the entire dies/workpiece assembly to prevent buckling of said workpiece and to ensure evenly shaped embossed characters.

9. The apparatus of claim 8, wherein said tray includes two parallel spaced-apart longitudinally extending rib formations, said plurality of dies being receivable in a predetermined interrelationship between said rib formations of said tray prior to locating said tray with said dies/work piece assembly between said press members for the embossing operation.

10. A method for embossing characters in a workpiece, such as a motor vehicle registration plate, said method comprising the steps of:

(a) providing an embossing apparatus including buckling prevention means for preventing buckling of said workpiece during the embossing operation, said buckling prevention means comprising a pair of cooperating press members reciprocally movable relative to each other and each having an operative face, at least one of said press members being movable and having an elongated configuration defining a piston which is snugly slidably received in a cylinder, said piston having an upper surface defining one of said operative faces, said piston and its operative face remaining substantially within said cylinder during movement of said piston in said cylinder, thereby preventing the operative face of the movable press member from moving out of alignment with the operative face of the other press member during movement of the movable press member relative to the other press member during the embossing operation, at least one die for embossing one or more characters in said workpiece, said at least one die comprising first and second pivotally interconnected die members, said workpiece during the embossing operation being trapped between said first and second pivotally interconnecting die members to provide a die/workpiece assembly, said die/workpiece assembly being locatable for the embossing operation between said pair of cooperating press members, said operative faces of said press members being of such dimensions that they extend over the whole of the die/workpiece assembly during the embossing operation, and at least one die element carried by said first die member;

(b) introducing a workpiece between said first and second pivotally interconnected die members to produce said die/workpiece assembly in which said workpiece is trapped between said first and second pivotally interconnected die members;

(c) advancing said die/workpiece assembly between said pair of cooperating press members;

(d) urging said press members into contact with said die/workpiece assembly to exert pressure over the entire die/workpiece to prevent buckling of said workpiece and to ensure evenly shaped embossed characters.

11. The method of claim 10, and further comprising providing a layer of material on said work piece, and cutting through said layer during the embossing operation.

* * * * *